US008228001B2

(12) United States Patent
Fan

(10) Patent No.: US 8,228,001 B2
(45) Date of Patent: Jul. 24, 2012

(54) METHOD AND APPARATUS OF DRIVING LED AND OLED DEVICES

(75) Inventor: Jianping Fan, Orange, CA (US)

(73) Assignee: Suntec Enterprises, Orange, CA (US)

( * ) Notice: Subject to any disclaimer, the term of this patent is extended or adjusted under 35 U.S.C. 154(b) by 631 days.

(21) Appl. No.: 12/380,075

(22) Filed: Feb. 24, 2009

(65) Prior Publication Data

US 2010/0213857 A1 Aug. 26, 2010

(51) Int. Cl.
*H05B 37/02* (2006.01)

(52) U.S. Cl. ..... 315/291; 315/294; 315/247; 315/276; 315/169.1; 315/188; 315/193

(58) Field of Classification Search ..... 315/291, 315/219, 307, 294, 224, 312, 247, 225, 276, 315/169.1, 169.3, 226, 172, 173, 185 R, 188, 315/193

See application file for complete search history.

(56) References Cited

U.S. PATENT DOCUMENTS

| | | | | |
|---|---|---|---|---|
| 7,378,805 | B2 * | 5/2008 | Oh et al. | 315/291 |
| 7,557,521 | B2 * | 7/2009 | Lys | 315/294 |
| 2008/0002103 | A1 * | 1/2008 | Lee | 349/68 |
| 2011/0068700 | A1 * | 3/2011 | Fan | 315/185 R |

* cited by examiner

*Primary Examiner* — Haiss Philogene
(74) *Attorney, Agent, or Firm* — Jianping Fan

(57) ABSTRACT

A group of novel power conversion concept is developed with this invention for LED and OLED drive applications. The concept utilizes a single power conversion stage to fulfill multiple functions, including Power Factor Correction, DC voltage to DC current conversion, or DC voltage to DC voltage conversion etc. that are necessary for driving LED devices from an AC power input. Multiple dimming control schemes have also been developed to facilitate wide range of application requirements and enable the system to work with different input power format including AC mains power and variable AC voltage from the existing AC dimmer installations.

4 Claims, 7 Drawing Sheets

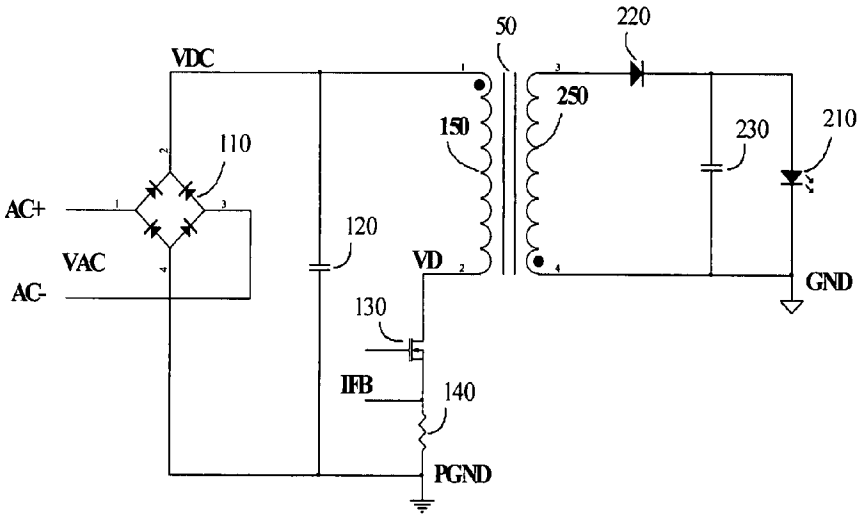
Fig. 3B
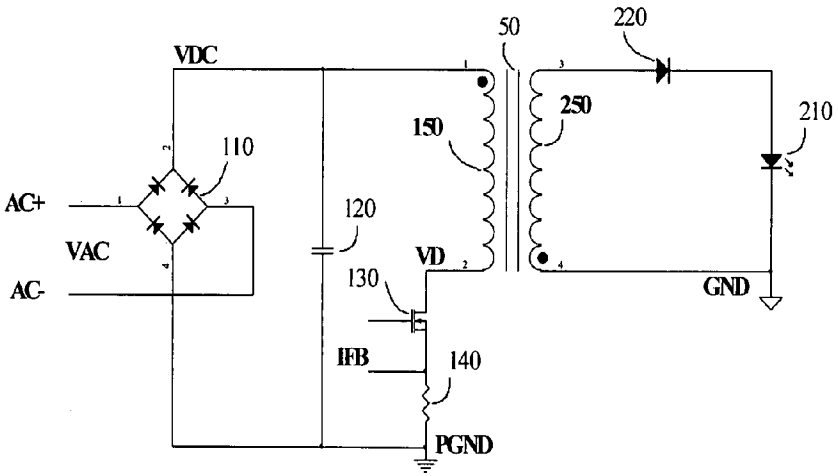
Fig.3A
Fig. 3

METHOD AND APPARATUS OF DRIVING LED AND OLED DEVICES

BACKGROUND OF THE INVENTION

1. Field of the Invention

This invention generally relates to methods of driving LED and OLED devices, and more particularly, to some unique concepts to drive LED and OLED devices with low cost circuits while providing high efficiency power conversion and comprehensive dimming control performance.

2. Description of the Related Art

Light Emitting Diode (LED hereafter) and Organic Light Emitting Diode (OLED hereafter) are bringing revolutionary changes to the lighting industry and the whole world. High efficiency, compact size, long lifetime and minimal pollution etc. are some of the main advantages that provide people elegant lighting solutions and in the meanwhile perfectly into the green power initiative. Because LED and OLED are all made with solid substances, they are also called Solid State Lighting (SSL hereafter) devices. The inherent mechanical robustness of SSL devices together with the features described above also enable themselves to provide more reliable solutions that other lighting devices cannot do, and create many new applications in our daily life.

Despite the technical advantages of the LED and OLED, high cost of the devices and especially the total lighting system solutions is the most critical factor that hinders the fast growth of the SSL applications. Apart from the device itself, the drive circuitry that converts the input electrical power from a commonly available format to a format that provides suitable voltage and current to the device, consists a large part of the system cost. In applications that the input power is from the mains AC power line of 110V or 220V, the cost of the drive circuitry would be more significant because of the complexity of the power conversion process that very often includes Power Factor Correction (PFC hereafter) circuit, DC to DC conversion, and dimming control circuit in particular.

FIG. 1 shows a typical approach of an AC powered LED drive system. For simplicity of the description, the figure shows only the power circuit architecture. As shown in the figure, inductor 160, power MOSFET switch 170, diode 180, and capacitor 120 comprise a boost type PFC circuit that converts the voltage rectified by bridge rectifier 110 from the AC line input VAC, to a DC voltage VDC while maintaining the input current from the AC line in a sinusoidal wave shape and in phase with the AC input voltage. As well known by the skilled in the art, PFC function is mandatory by European standard for all the electric apparatuses that draws 75 W or above from the mains AC line, and very soon such requirement will be extended to lower power level. The output voltage of the PFC stage is normally around 180 VDC for 110V AC input, and 380V for 220V AC input. These voltage levels are defined such that they are slightly higher than the maximum AC input peak which is $VAC_{NOM} \cdot 110\% \cdot \sqrt{2}$, in order to maintain proper operation of the PFC circuit. Lower than this level will result in the possibility of uncontrolled conduction of the diode 180. Here $VAC_{NOM}$ represents the nominal mains AC voltage, i.e. 110V or 220V (240V for British system).

Since the operating voltage of LED device or most LED strings is lower than the PFC output voltage, a DC to DC conversion stage is employed to convert the PFC output voltage VDC to a lower DC voltage that suitable for driving the LED devices. MOSFET switch 130, power transformer 50, rectifier diode 220 and capacitor 230 in FIG. 1 forms a fly back type of DC to DC conversion stage. The voltage established on capacitor 230 is the converted voltage for LED drive. Apart from the illustrated fly back converter configuration, other types circuit topology such as forward, push-pull, half bridge, or full bridge can also be employed to perform the DC to DC conversion function. The operating principles of those circuits are well known to the skilled in the art and will not be elaborated herein.

In lighting applications LED or OLDE are normally current controlled devices of which the light output of the device is proportional to the forward current flowing through it. On the other hand in the forward conduction region of the device the dynamic impedance is very low, i.e. a relatively small change of the forward voltage will result in a large change of the forward current. In order to maintain the forward current of the device at a desired value or control the current at different level according dimming requirement, a drive circuit is normally employed to control the current flowing to the LED device as shown in FIG. 1. Note that the LED symbol in the figure represents an LED lighting assembly in general. It could be a single LED or OLED device, or an LED string or OLED string consisting multiple devices connected in series.

It is obvious that such approach involves multiple power conversion stages and utilizes multiple power devices to accomplish the whole power control process. The system efficiency suffers from the multiple stage power conversion, and the cost of the system is too high compared with other lighting solutions to prevent its wide adoption in many applications, especially the high volume general lighting area. Therefore it is the intention of this invention to introduce an innovative LED drive concept with high operating efficiency and lower system cost to better fit the market needs.

SUMMARY OF THE INVENTION

This invention proposes a concept to drive LED and OLED devices with simplified power conversion process and simplified circuit design. The proposed concept eliminates the voltage to voltage or current to voltage conversion stage in the conventional process and uses a current mode conversion circuit to drive the LED devices directly. It simplifies the conventional two stage or three stage design of the LED drive system to a single stage circuit for most applications. The concept also provides high versatility to the LED drive system design such that system behavior can be modified by minimal change of circuit design to support different applications.

In one embodiment a single stage fly back power converter is employed to drive the LED device directly with the output from the transformer secondary winding. The power switching element on the primary side of the converter can be controlled with different switching scheme to yield different system behavior. When the power switch works at fixed duty cycle and fixed frequency mode, the current profile of the LED changes proportionally with the input voltage. Such system can work with the existing AC dimmer installation in households as a dimmable light source.

In one embodiment if the power switch works at a fixed frequency and constant current mode, the LED current profile and brightness can be held constant regardless of the input voltage change. The LED current can be adjusted with a control signal to provide dimming control in continuous operation mode. Alternatively, the total light output can also be adjusted by turning converter on and off periodically in burst mode and changing the on duty in each period. And further, the dimming control can combine the two modes together to offer wider dimming range.

In one embodiment the current profile of the power switch can be controlled to follow a sinusoidal wave shape that is in phase with the input AC voltage to incorporate a PFC function in a single power conversion. The LED current profile follows the power switch current profile proportionally and the LED brightness can be adjusted by the amplitude of the sinusoidal wave shape of the power switch current.

In one embodiment the LED carries out the function of both light emitting and reverse voltage blocking. Such approach eliminates the power loss and saves the cost of the rectifier diode. In the case the reverse voltage is higher than the LED reverse blocking capability, a serial diode can be used to protect the LED. A capacitor can also be connected in parallel with the LED to smooth out the ripple current.

In one embodiment the LED drive system can also perform burst dimming when connected to a conventional AC dimmer. The converter circuit can work at a fixed frequency and constant current mode during on period, and the burst on duty changes linearly with the output voltage from the AC dimmer. The burst dimming control can also be realized on the secondary side. The primary power switch works in fixed frequency, constant on time mode in such approach. A unique control concept is provided hold the LED current at a constant value, and the on duty of the burst changes automatically with the input voltage from the AC dimmer.

In one embodiment a single converter stage fulfills both functions of PFC and DC to DC voltage conversion. A regulated DC voltage can be obtained from the conversion stage and supplies to multiple LED devices in parallel. A second stage LED drive circuit is employed to provide independent control for each LED device or LED string.

In one embodiment a lossless snubber is employed to suppress the voltage stress on the power switch. Due to the stored energy in the transformer leakage inductance, severe voltage spike could occur at the power switch turn off transition. The lossless snubber absorbs the leakage energy at turn off transition and feeds the energy back to the system when the power switch turns on.

In another embodiment a chopper circuit is used to drive the LED from a DC or rectifier AC voltage directly. When the forward voltage of the LED or LED string is close to the input voltage such approach can avoid the effect of the transformer leakage inductance and yield higher efficiency. A current mode control is employed for such application.

BRIEF DESCRIPTION OF THE DRAWINGS

FIG. 3 shows two typical variations of the system in FIG. 2. One with a diode in series with the LED to increase reverse blocking capability, and the other further with a capacitor in parallel with the LED to smooth out the ripple current.

DETAILED DESCRIPTION OF THE INVENTION

Figure 2A:
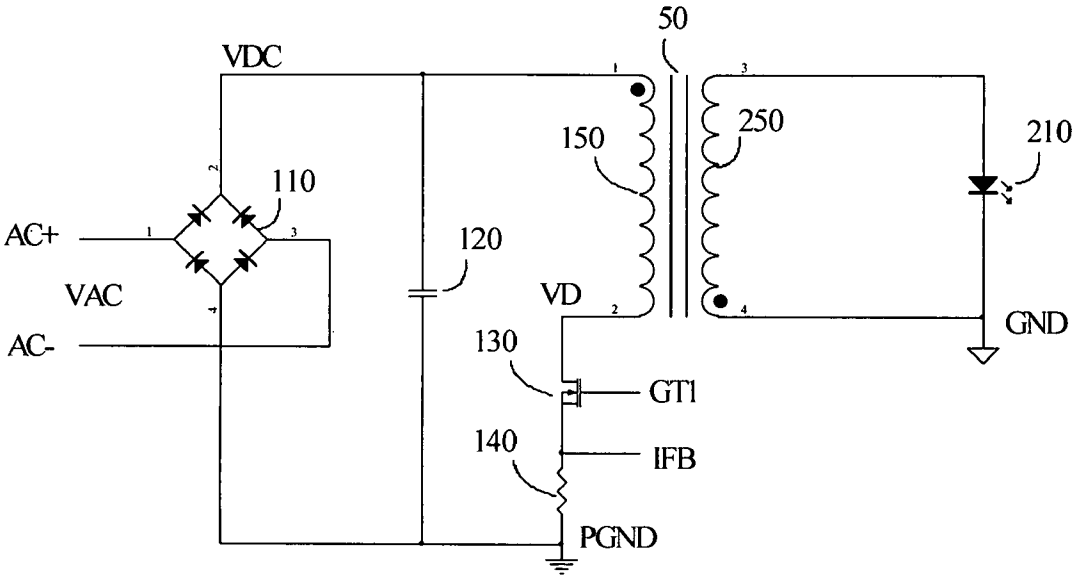
FIG. 2 shows a typical single stage LED drive system of this invention with the LED device plays additional function of rectifier diode, and the operating waveforms of the circuit.

As described in the last paragraph the purpose of this invention is to find a viable drive solution for LED and OLED devices with low system cost and also enhanced operating efficiency. The first critical part of the invention is innovative concepts in power conversion or power processing. FIG. 2A shows a typical circuit diagram of the concept. In FIG. 2A the components 110, 120, 130, 140, 50 and 210 form the power converter circuit. Note that the essence of this invention is the power conversion process and herein the description of the control circuitry is minimized unless when is necessary for understanding the concept. As can be seen in FIG. 2A, AC input voltage VAC is connected to the AC input terminals AC+ and AC− of the bridge rectifier 110 and converted to a unipolar voltage by the bridge with positive output connected to VDC and the negative output connected at power ground PGND. The AC input VAC can be the mains line voltage, chopped AC voltage from a conventional triac or thyristor based dimmer, or other types of AC supply. A filter capacitor 120 is connected between VDC and PGND. The capacitance value of the capacitor can be chosen according to the application purpose and the converter power level. Large capacitance value can be chosen to smooth out the ripple voltage and make VDC near a pure DC voltage. If PFC function is required, it can use a small value that is just sufficient to filter out the ripple produced by the high frequency switching of the power switching device 130, and still maintain the rectified sinusoidal wave shape at the mains frequency. Switch 130, sense resistor 140, transformer 50 and LED device 210 comprise a voltage to current conversion stage. The dotted terminal of the primary winding 150 of the transformer is connected to VDC and the non-dotted terminal connected to the drain of switch 130. The current sense resistor 140 is connected between the source of 130 and power ground PGND. The LED device 210 is connected to the secondary winding 250 of transformer 50 with its anode connected to the non-dotted terminal and cathode to the dotted terminal. Note that the LED symbol 210 in FIG. 2A essentially represents an LED lighting assembly in general. It can be a single LED or OLED device, or an LED string or OLED string consisting multiple devices connected in series. It should also be noted that power switch 130 is represented by a MOSFET for example only. By all means that other power switching devices can also be used without departing from the spirit of this invention.

The circuit comprised by 130, 140, 50 and 210 is essentially a boost type converter stage. During operation when 130 is turned on, VDC is impressed to the primary winding 150 of the transformer and an inductive current flows from VDC through 150, 130 and 140 to PGND and builds up linearly. On the secondary side the induced voltage in secondary winding 250 appears positive on the dotted terminal and negative on the non-dotted terminal, and thus LED 210 is reverse biased. When 130 is turned off the current stored in the primary winding reverses the voltage polarity of the transformer windings when it tends to maintain its continuity. Thus the voltage polarity of the non-dotted terminal of primary winding 150 and secondary winding 250 both become positive. The LED becomes forward biased and forms a circulation loop with the secondary winding 250 to relay the current from the primary winding.

Figure 2B:
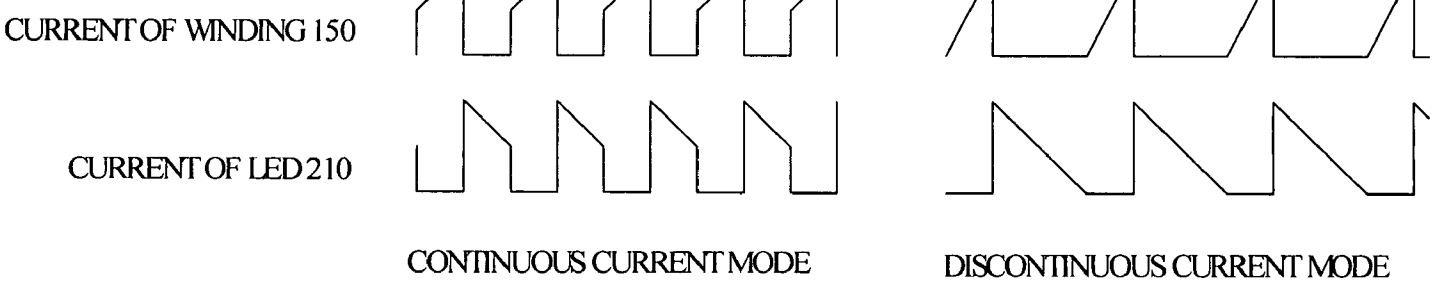

In this approach the LED serves as the load to convert the electrical energy to light and in the meanwhile also as a rectifier diode device in the power conversion process. With the absence of the rectifier diode that usually employed in a power converter, it has saved not only the associated cost, but also the power loss on the diode. This whole circuit serves as a complete and simple voltage to current converter that can control the LED current from the primary side directly. With a given DC voltage VDC, the peak current of the primary winding 150 is proportional to the on time of 130, and during the fly back process when 130 is off, the current flowing though the LED is proportional to the primary current according to the turns ratio between 150 and 250. Based on this power conversion process the LED current can be controlled from primary side in either an open loop or closed loop manner. Open loop control can set the on duty of the power switch directly and the LED current changes proportionally with the on duty. One possible way of closed loop control is to sense the transformer primary current from the voltage drop on 140 and feedback to the control circuit to maintain the LED current at a determined value. Further, the converter circuit can work in either continuous or discontinuous mode to fit different application requirement. In continuous mode 130 turns on before the current in the primary winding WP decays to zero. In discontinuous mode 130 turns on after the current in the primary winding decays to zero. Typical operating waveforms of continuous and discontinuous current operations are illustrated in FIG. 2B.

As mentioned before, the capacitance value of capacitor 120 can vary to support different applications. In the case that PFC function is not required, the AC input VAC is a chopped mains voltage from a conventional triac or thyristor based dimmer, a large capacitance value can be selected to smooth out the ripple and make VDC near a pure DC voltage. For instance, if the input VAC is from a triac or thyristor based dimmer, the voltage appears as a part of the mains sinusoidal waveform chopped by the phase control of the triac device, as shown in FIG. 2B. The average value of the voltage varies with the firing angle, bigger firing angle results in smaller area of the voltage waveform and hence smaller average value. This type of dimmer is widely installed in house holds to control the dimming of the lighting devices such as incandescent lamp bulbs, fluorescent lamps, halogen lamps etc. When the circuit described in FIG. 2A is connected to such AC input with a large filter capacitor, VDC becomes a near pure DC voltage with its amplitude reflects the average value of the AC input. Under such circumstances, if 130 switches at a manner of constant on time and constant frequency, and the transformer primary current is controlled at discontinuous mode, i.e. 130 always turns on after the primary current is decayed to zero, the peak current developed in the transformer primary winding 150 becomes proportional to the value of VDC and consequently, the average value of the AC input VAC. Because in discontinuous mode the energy stored in the primary winding during on period of switch 130 is completely transferred to the secondary side and dissipated on the LED, the current of LED is proportional to the primary winding current according to the transformer turns ratio. Therefore the final result is that the LED current changes proportionally with the AC input voltage with constant on time, constant frequency, and discontinuous current operation of the circuit. With such result the proposed circuit in FIG. 2A can readily replace the existing lighting devices and work with the existing dimmer installations in residential households.

Figure 4:
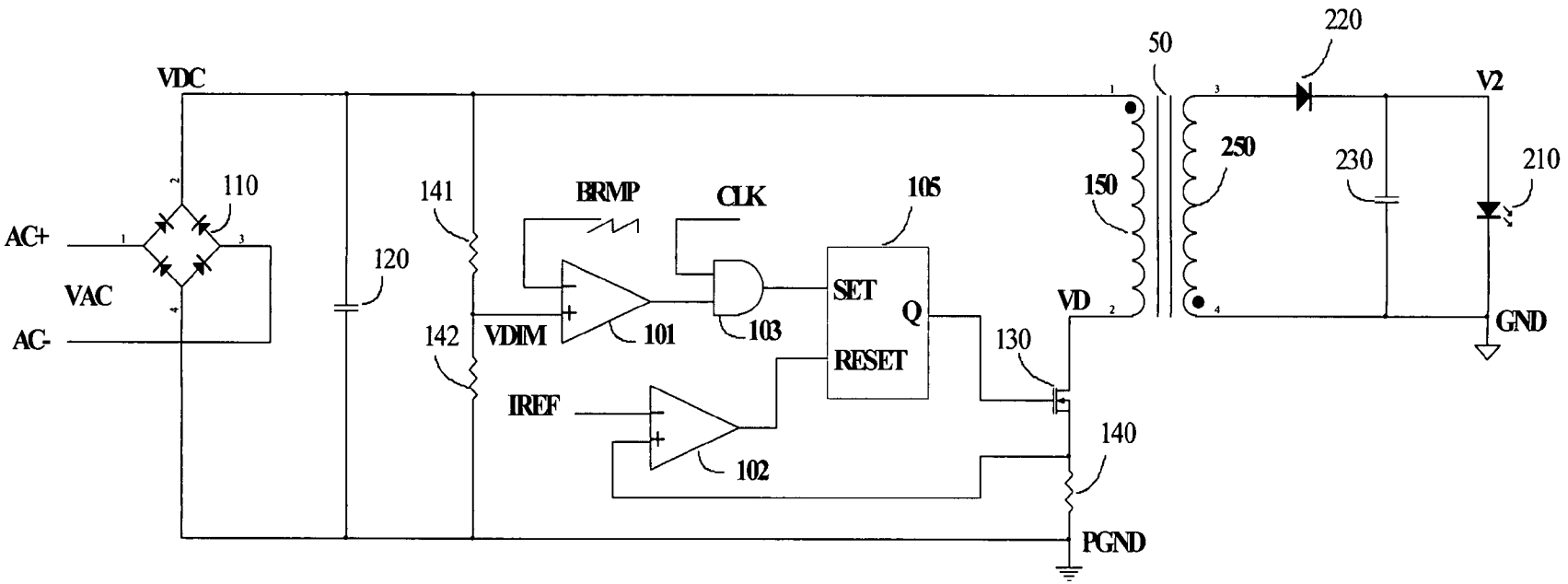
FIG. 4 shows a more versatile system of the invention with burst dimming control from the primary side.

Such fixed on duty and fixed frequency operation can also be used when the AC input VAC is from the mains supply directly. It is simple and low cost and can be a viable solution for general lighting applications. The drawback is that the LED current varies with mains voltage and therefore the brightness is not constant at unstable input voltage. In the case that constant brightness is desired, the LED current can be controlled with closed loop operation. Such function can be readily achieved by using the sense signal from 140 as a feedback to regulate the on duty of 130 with a PWM control circuit. The concept is illustrated in FIG. 4. As will be explained in the related paragraphs later, with closed loop control not only constant brightness can be maintained with constant LED current, dimming operation can also be achieved by either changing the LED current amplitude in continuous operation mode, or changing the on duty of the LED in burst operation mode with constant LED current during burst on period, or combining the current amplitude change and burst on duty change together. More detailed explanation of such dimming operation will be elaborated in the related description of FIG. 4.

In the above described approach when power switch 130 is turned on the LED is reverse biased. In most applications the circuit can be designed in such a way that the reverse voltage stress on the LED is lower than its reverse voltage blocking capability. If the reverse voltage is higher than the LED reverse blocking capability due to a particular reason in some designs, a diode can be connected in series with the LED to reinforce the reverse blocking capability. FIG. 3A shows such concept with an additional diode 220 connected in series with the LED. The diode can be a Schottky diode or fast recovery diode to help improving the reverse recovery behavior of the LED circuit.

In FIG. 2A and FIG. 3A the LED current is in a form of decayed pulses. In the case that a continuous LED current is desired, a smoothing capacitor 230 can be connected in parallel with LED at the cathode of 220, as shown in FIG. 3B. In such approach 220 and 230 essentially work as the secondary rectification circuit of a flyback converter. With sufficient capacitance, capacitor 230 will be able to hold a DC voltage and supply a constant DC current to the LED. The voltage on 230 will be established to a particular value automatically such that the energy dissipated in the secondary side, which includes the energy consumed by the LED and the losses in the other part of the secondary circuit, is balanced with the energy transferred from the transformer primary side. With a given AC input and constant on time of 130 at a fixed switching frequency, the energy transferred in each second is also constant as following:

$$P_1=(1/2)\cdot(V_{DC}^2T_1^2/L_1)\cdot f \qquad \text{[Eqn. 1]}$$

Here $P_1$ is the power transferred from the transformer primary side. $T_1$ is the on time of 130, $L_1$ is the inductance of the transformer primary winding 150, and f is the switching frequency of 130. If the power conversion efficiency is assumed to be constant and represented by a symbol η, by taking account of the total losses in the conversion process, the power consumed by the LED is $$V_{LED}\cdot I_{LED}=\eta P_1 \qquad \text{[Eqn. 2]}$$

From the above equations it is clear that when $T_1$, $L_1$ and f are constant, the power transferred to the LED device is proportional to the square of $V_{DC}$ and hence the average value of $V_{AC}$. LED lighting systems operating in such manner can replace the existing lighting fixture to work with a conventional AC dimmer and perform dimming function as usual.

On the other hand, in many applications it is desirable to keep the LED current constant in order to maintain a constant brightness when the input voltage varies. And further in some applications brightness change is required under a controlled manner. In such circumstances closed loop control for the LED current is needed and the brightness can be controlled by either the LED current amplitude, or a method called burst dimming, or a combination of both. In burst dimming operation the LED is turned on and off periodically at a given frequency, and the brightness is controlled by the burst on duty. The circuit illustrated in FIG. 4 shows an example of such operation. One embodiment in FIG. 4 realizes a constant current mode operation by comparator 102, AND gate 103, and flip-flop 105. In FIG. 4 CLK is a train of narrow pulse clock that controls the switching frequency of 130. CLK is connected to one of the input of 103, and another input of 103 is connected to burst dimming control signal BDIM. The output of 103 is connected to the set input of the flip-flop 105. When BDIM is at high state, the switching clock signal CLK is fed to the set input of 105 and set its output Q to high state at the rising edge of CLK, and thus turning 130 on. When 130 is turned on, current starts to flow through the transformer primary winding 150 and ramp up linearly. This current is sensed by resistor 140 and fed to the non-inverting input of comparator 102. When the voltage developed on sense resistor 140 reaches the reference voltage IREF that applied at the inverting input of 102, the output of 102 changes state from low to high and reset the flip-flop 105 from its reset input and turns 130 off. When 130 is turned off, the transformer primary current is cut off and the voltage across 140 drops to zero. The output of 102 then returns to low state and the circuit is ready to initiate the next switching cycle with the following CLK signal. Such process repeats automatically at every rising edge of the switching clock CLK when BDIM signal is high. Under such operating mode the peak of the transformer primary current is constant at every switching cycle, and the energy converted from the transformer primary side in each second is constant regardless of the voltage level of VDC and VAC, and is expressed as following:

$$P_1=(½)\cdot(L_1I^2)\cdot f=(½)\cdot[L_1(I\mathrm{REF}/R_1)^2]\cdot f \qquad \text{[Eqn. 3]}$$

Here L1 is the inductance of transformer primary winding 150, and $I_1$ the peak current of 150. Since the energy balancing relation is the same as equation [Eqn.2] and the LED forward voltage $V_{LED}$ can be assumed constant in a small range of LED current variation, the LED current $I_{LED}$ will be constant if $I_1$ is set constant by IREF. On the other hand, if continuous dimming control is needed, the current of LED 210 and consequently its brightness can be adjusted by changing IREF level accordingly.

The burst dimming control signal is generated by comparator 101. As shown in FIG. 4, the non-inverting input of 101 is connected to the common node of a resistor divider consists of resistor 141 and 142. The other terminal of 141 is connected to the DC voltage VDC. So the voltage VDIM on the non-inverting input of 101 is proportional to VDC. The inverting input of 101 is fed with a saw tooth waveform BRMP that sets the frequency of the burst dimming operation. The output of 101 is the burst dimming control signal BDIM that is fed to the input of 103. When the voltage level of BRMP is lower than VDIM, the output BDIM of 101 is at high state and the switching operation of 130 is activated. When the ramp of BRMP rises above VDIM level, BDIM changes to low state and turns off the switching operation of 130. Thus the switching operation of 130 can be turned on and off periodically in synchronous with the frequency of BRMP, and the duty of the on period is proportional to the voltage level of VDIM when VDIM is in the range between the valley and peak level of BRMP. Because VDIM is proportional to VDC and consequently the average value of VAC, the on duty of the burst dimming is also proportional to VAC. It is clear that LED lighting systems with such feature can use conventional tiac based dimmer to control their brightness. On the other hand, there are other applications that the dimming operation is controlled with a control signal instead of the output voltage from a conventional AC dimmer. For such applications, the only difference is removing the resistor divider 141 and 142 in FIG. 4 and apply the control signal to the non-inverting input of 101 as the burst dimming control signal VDIM. In such circumstances, the signal VDIM can be a DC signal with its value between the peak and valley point of the saw tooth signal BRMP, or alternately, a Pulse Width Modulated (PWM) pulse train with its high state level higher than the peak value of BRMP and the low state level lower than the valley point of BRMP. Note that with the described pulse train signal format, the saw tooth signal BRMP is overridden and both the duty and frequency of the burst operation follow the PWM pulse train directly. The LED current can be held constant during burst dimming by a constant IREF, or changed with variable IREF to add another dimension of dimming control and widen the dimming range. Note that the circuit in FIG. 4 shows only the principle and a typical example of realizing the elaborated concept. In practice the realization of such concept is by no means limited to the circuit described in FIG. 4.

Figure 5:
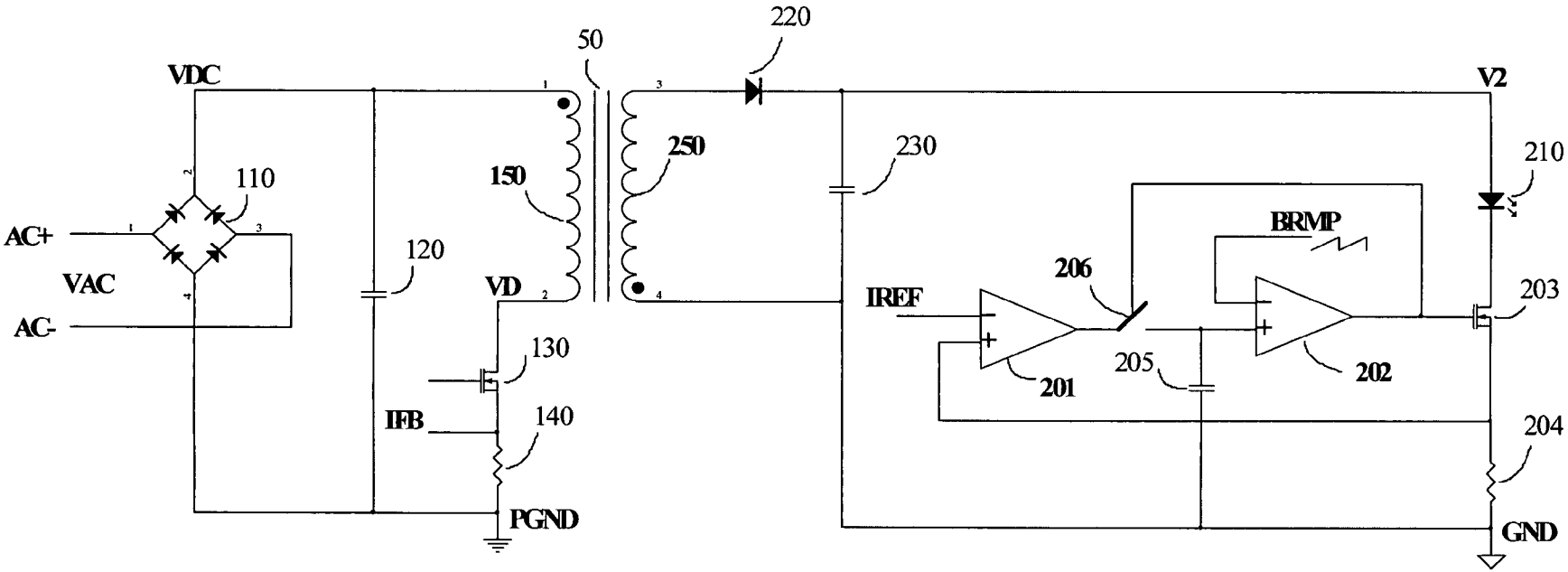
FIG. 5 shows another system configuration with burst dimming control on the secondary side.

Apart from the approach described in FIG. 4, dimming control can also be realized on the secondary side. FIG. 5 shows one embodiment of secondary side burst dimming control with its on duty proportional to the AC input voltage at constant LED current. As shown in FIG. 5 a MOSFET switch 203 and a current sense resistor 204 is connected in series with the LED device 210. The switch 203 is used to turn on and off the LED current. Its gate is controlled by the output of the burst pulse generation comparator 202. The inverting input of 202 is fed with a burst ramp signal in saw tooth wave shape, and the non-inverting input of 202 is connected to a filter capacitor 205. The filter capacitor 205 and the non-inverting input of 202 are further linked to the output of an error amplifier 201 through a bidirectional switch 206. The switch 206 is control by the same signal as 203 from the output of 202 such that when the control signal is high, both 203 and 206 is turned on, and when low both 203 and 206 are turned off. The error amplifier 201 is a GM type, i.e. a voltage controlled current source type with its output current proportional to the voltage difference between its inverting and non-inverting input. The inverting input of 201 is fed with a reference voltage as the reference for the LED current. The non-inverting input of 201 is connected to the current sense signal from 204.

During operation the primary switch 130 is operating at constant on time and constant frequency mode. Therefore as described in paragraph [0031] by equation [Eqn. 1], at a given AC input voltage the energy transferred to the secondary side in each second is constant, and with a variable AC input voltage the transferred energy in each second is proportional to the square of the average value of the input voltage. On the secondary side the on and off of 203, and hence the on and off of LED 210, is controlled by the output of comparator 202. The inverting input 202 is fed with the burst ramp signal BRMP. When the amplitude of BRMP is lower than the voltage at the non-inverting input, i.e. the voltage across capacitor 205, CMP outputs a high state and turns on 203. Vice versa when BRMP is higher than $V_{205}$, 202 outputs a low state and turns off 203. So essentially BRMP sets the burst operation frequency of the LED, and $V_{205}$ controls the on duty of the burst. When the output of 202 turns on 203, it also turns on the control switch 206 and connects 205 to the output of error amplifier 201. During this 203 on period if the LED current feedback signal from 204 is higher than the reference signal IREF at the inverting input of 201, EA generates a sourcing current from its output and charges capacitor 205 up, and if the feedback signal is lower than IREF, 201 outputs a sinking current and discharge capacitor 205. The end effect of such operation is that when LED current is high than the value set by IREF, the burst duty increases, and when LED current is lower the value set by IREF, the burst on duty decreases. As described at the beginning of this paragraph, the power transferred to the secondary side is a constant value with a constant on time switching operation of switch 130 at fixed frequency and a given AC input. Therefore when the LED current is higher than reference and pushes the on duty of 203 to increase, the power consumption of LED will increase and results in the secondary output voltage V2 to drop. The LED current will then reduce accordingly to tend to match the reference value. Vice versa when the LED current is lower than reference, the burst on time and hence the power consumption of the LED will decrease and V2 will tend to rise and consequently bring the LED current up to match the reference. So in a brief summary, the described circuit is a closed negative feedback loop to keep the LED current at a constant level by adjusting the burst on duty. At a constant LED current setting, the LED burst dimming on duty changes proportionally to the square of the average value of the AC input voltage. Note that the capacitance of capacitor 205 is selected to be large enough to make its voltage a slow changing DC voltage during the burst dimming operation. When the LED is off, the output of 201 is disconnected from 205 and therefore the change of 205 voltage is only related to the active control result from 201 when the LED is on.

Figure 1:
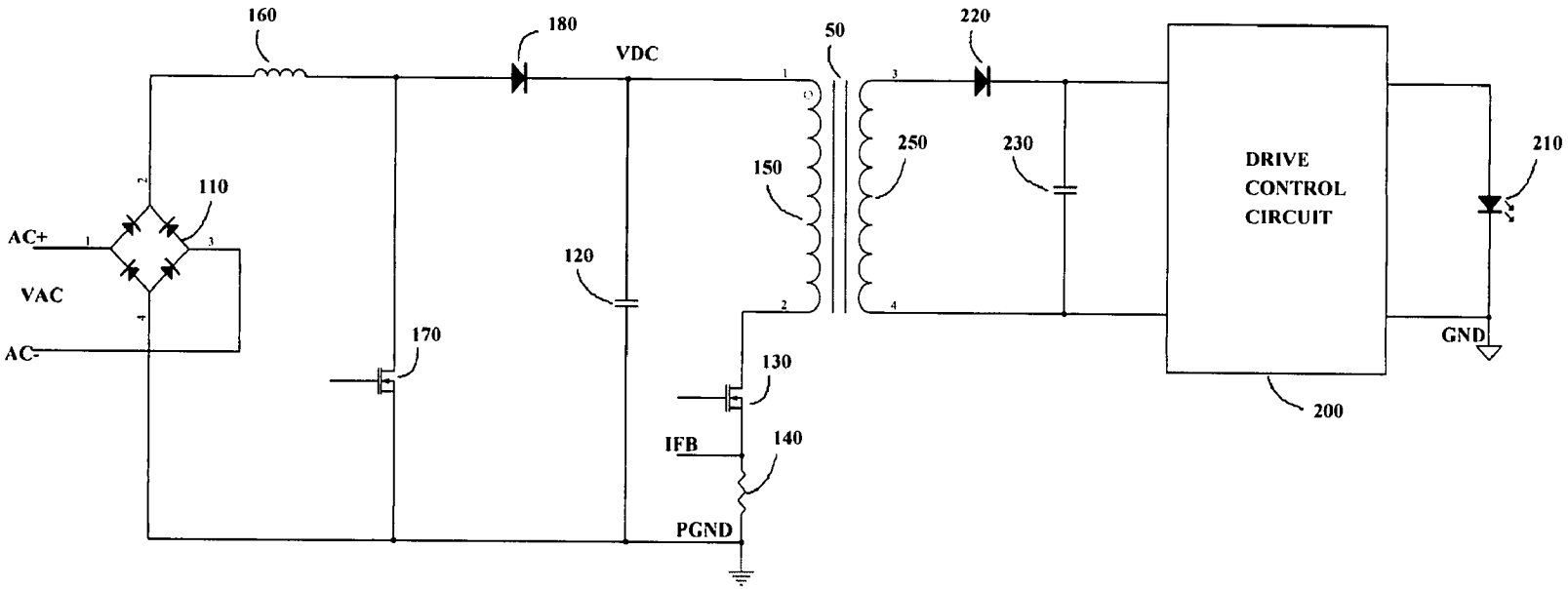
Fig. 1 PRIOR ART
FIG. 1 shows a conventional LED drive system approach that consists of a PFC stage, a DC to DC voltage conversion stage, and an LED drive control stage.

In many applications today Power Factor Correction (PFC) is required in order to improve the supply quality and capacity utilization of the power systems. The concepts introduced above can also satisfy such requirement with the same circuit architecture. The only difference is the selection of the capacitance of 120 and the switching control of switch 130. Instead of using a large capacitance to smooth out the rectified AC ripple to make VDC near a pure DC, smaller capacitance has to be chosen for 120 to be just sufficient to filter out the switching ripple at operating frequency of 130, and VDC still maintains a full wave rectified sinusoidal wave shape at the mains frequency. With such arrangement the rectifier bridge 110 is almost always conducting and the AC input current keeps continuous flow. Thus with proper switching control of 130, the input current from the AC input AC+ and AC− can be shaped to follow a sinusoidal waveform and in phase with the AC input voltage. The PFC switching can use the same control methods for boost type PFC converter as illustrated in FIG. 1. Those methods include fixed on time switching control, critical conduction switching control, average current control etc. These methods are standard approaches in the field and will not be elaborated herein.

The unique feature of this invention is that a single stage conversion circuit as shown in FIG. 2A, FIG. 3A and FIG. 3B can fulfill the whole LED drive function including PFC control, voltage to current conversion, and LED current regulation. One fundamental fact for such approach is that PFC circuit is essentially a current controlled converter and LED is a current driven device. Therefore it is much more favorable to drive the LED devices with the controlled current from PFC stage directly instead of converting the PFC output to a voltage source and then make another conversion from voltage to current to drive the LED. Another distinctive feature herein is that a flyback type of transformer, indicated as 50 in FIGS. 2A, 3A and 3B, is used in the conversion circuit instead of an inductor, as indicated as 160 in FIG. 1. This yields the capability of adjusting the LED drive voltage with the transformer turns ratio, and allows the approach to drive the LED device from the transformer secondary winding directly. With the conventional PFC approach in FIG. 1, a step down DC to DC stage has to be employed in order to get the right voltage for LED operation because the PFC output voltage has to be higher than the input AC peak, which has no way to be close to the LED operating voltage.

For such one stage PFC and LED drive combo operation with the circuit described in FIG. 2A, power switch 130 is turned on and off according to the switching rule to control the profile of the input current to follow a sinusoidal wave shape. When 130 is turned on the current of the primary winding 150 ramps up. When the current reaches the amplitude at the particular point of the desired sinusoidal wave shape, 130 turns off and the current established in the primary winding 150 is coupled to the secondary side and flowing through the LED. The principle of continuity of the coupled inductive current determines that at the switching over instant the initial current of the LED is always proportional to the primary winding current at that particular moment according to the transformer turns ratio. So effectively when the profile of the transformer primary side current is controlled according to a rectified sinusoidal wave shape, the profile of LED current follows the same wave shape proportionally. With such operation behavior the PFC function is achieved by controlling the profile of the transformer primary current to follow a sinusoidal wave shape, and the LED current and brightness control function is achieved by adjusting the amplitude of the sinusoidal wave shape. On the other hand, it should be noted that in this approach the LED current is not a constant DC but rather, with sinusoidal ripples at twice of the mains frequency. It is understandable that the instantaneous brightness of the LED light source will have the same ripple effect as the LED current. However, such effect is normally invisible to human eyes as the ripple frequency is high enough to be filtered by human eye response. In fact, the light from most of the conventional AC powered lighting devices today has the similar effect. If such ripple is a concern in some particular applications, the drive circuit of FIG. 3B can be employed to put a capacitor in parallel with the LED to smooth out the ripple current.

When the circuits in FIG. 2A, FIG. 3A and FIG. 3B are used as single stage PFC and LED drive combo operation, the dimming control can only be performed in a continuous mode by changing the amplitude of the sinusoidal current waveform. Burst dimming is difficult to perform on the primary side directly because the switching operation of 130 cannot be interrupted. As a matter of fact, continuous dimming is normally sufficient for most of the general lighting applications. In case burst dimming is required, the circuit in FIG. 5 can provide an economic solution. As explained in paragraph [0031] and [0032], the circuit on the secondary side can maintain the LED current at a constant level and automatically adjust the burst on duty according to the level of the power transferred from the primary side. This essentially means that when adjusting the sinusoidal current amplitude of the PFC operation on the primary side, the transferred power level and hence the burst duty of the LED current will change accordingly, and therefore a burst dimming operation can be realized from primary side control by changing the PFC current level while maintaining continuous PFC operation. Such control is realized by the intrinsic power balancing mechanism of the system and hence there is no feedback from secondary to primary side is needed.

Figure 6:
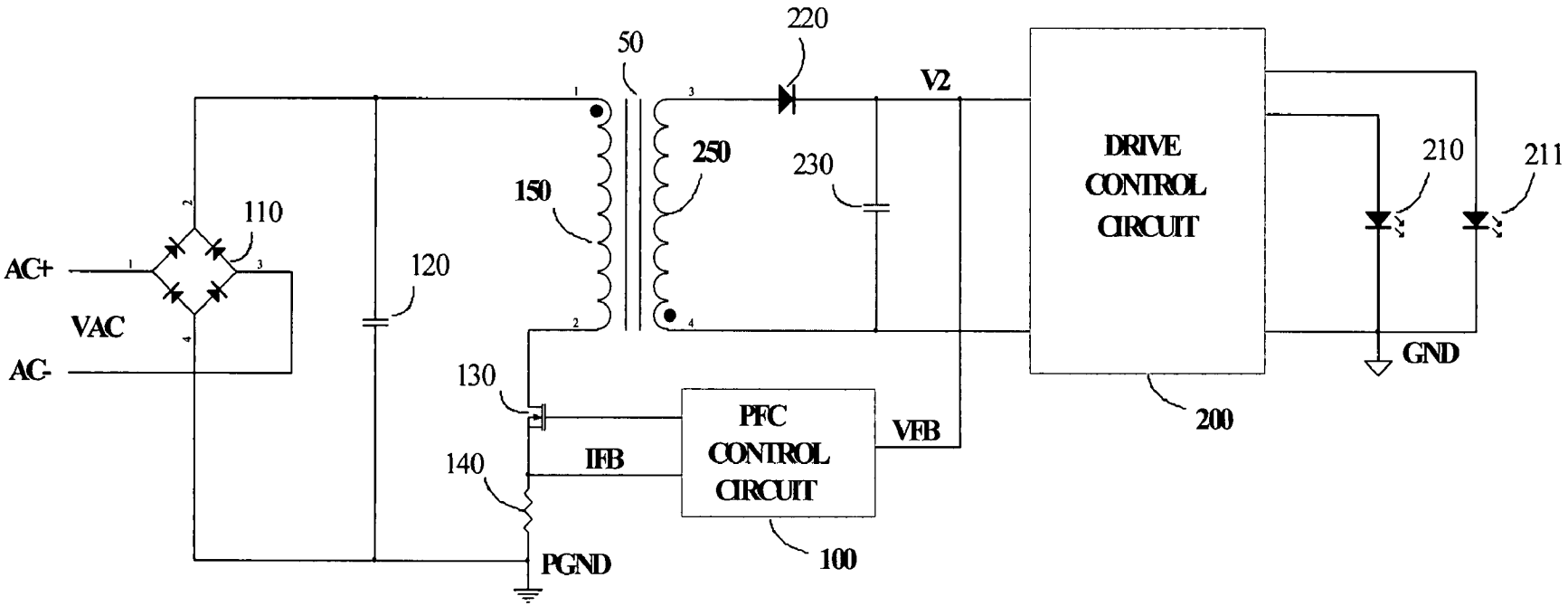
FIG. 6 shows a two stage system with the first stage converts the input voltage to DC voltage on the secondary side and the second stage performs drive control to drive multiple LED branches.

The circuit in FIG. 5 is an economic solution for single load operations. When driving multiple LED in parallel, and especially if independent dimming control is needed for each LED branch, dedicated LED drive circuit with a relatively constant input voltage is more desired. FIG. 6 illustrates an example of such a circuit architecture. As shown in FIG. 6, transformer 50, power switch 130, sense resistor 140, rectifier diode 220 and filter capacitor 230 comprise a single stage conversion circuit to obtain a DC voltage V2 across capacitor 230, and a drive control circuit 200 takes V2 as its input voltage to drive LED branches 201 and 211 in a parallel manner. It should be noted that it shows only two LED devices as an example for explanation to represent multiple LED branches. It by no means limits the number of LED branches to be driven under the same spirit of the invention. Compare with the conventional circuit in FIG. 1, one of the advantages of the system in FIG. 6 is that the PFC and DC to DC conversion function are fulfilled by a single stage operation. The operating principle of such single stage conversion has been explained in the previous paragraphs and will not be repeated herein. A particular point to emphasize is that a constant secondary voltage V2 is desired in such application, and therefore the PFC control circuit senses the voltage from V2 as a feedback signal for the switching control of 130.

Figure 7:
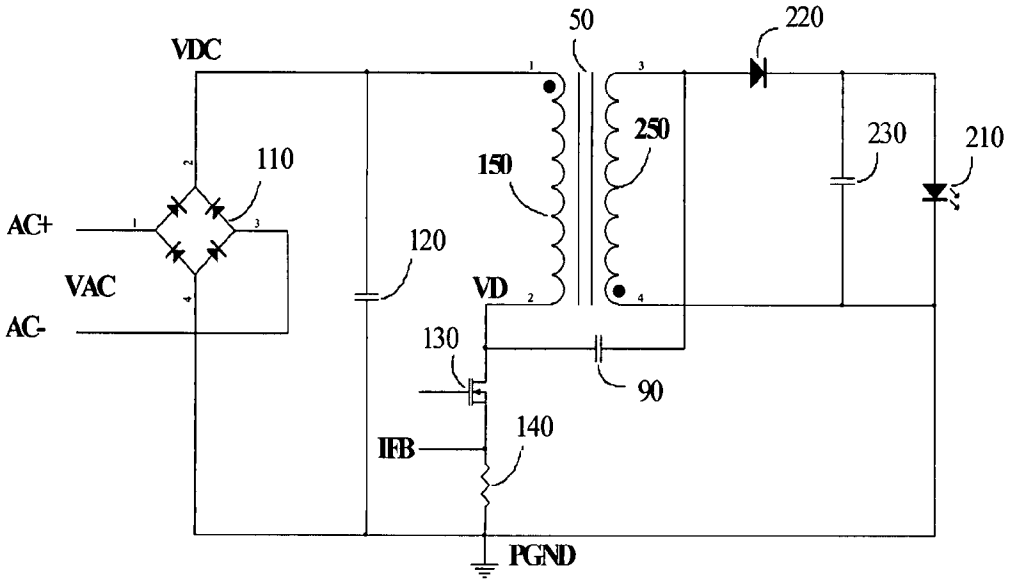
FIG. 7 shows a system that employs a lossless snubber to absorb the leakage inductance energy and suppress the switching spike stress on the power device.

One practical issue need to note is the leakage inductance effect of transformer 50. Because the energy stored in the leakage inductance cannot be coupled to the secondary side, when 130 is turned off, excessive voltage spikes could be stressed at its drain. Such situation could overheat or even break down the device and reduce the efficiency of the operation. One embodiment in FIG. 7 shows a solution to such problem. As shown in FIG. 7, a capacitor 90 is connected between the non-dotted terminals of the transformer primary and secondary winding. During operation when 130 is turned off, the energy stored in the leakage inductance circulates through the path of 90, 220, 230 and LED 210 in parallel, and 120. With sufficient capacitance of 90, this circulation path can absorb the turn off voltage spike very effectively. When 130 turns on, the energy stored in 90 circulates through the path of 130, 140 and secondary winding 250 and transfers the energy to the secondary side. Because of the non-dissipative energy transfer in such operation, the capacitance of 90 can be selected with relatively large value to suppress the turn off spike more effectively. This concept is applicable with the circuits described in FIGS. 2A, 3A, 3B, and FIGS. 4, 5 and 6. Apart from the above elaborated approach, conventional dissipative type of snubber can also be used in those circuits. This type of dissipative snubber circuits are well known by the skilled in the art and will not be further elaborated herein.

Figure 8:
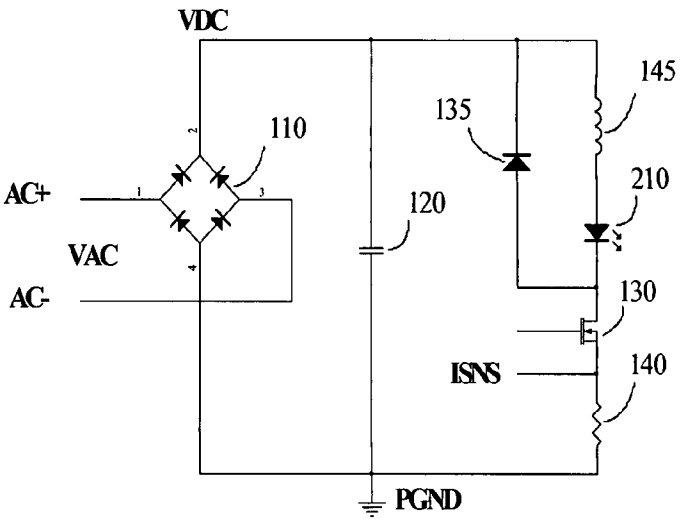
FIG. 8 shows another circuit architecture of the invention to drive the LED with a non-isolated, inductor based single stage drive circuit.

If the operating voltage of the LED device is in an order close to the input voltage and electric isolation from the input side is not needed, it can be driven from the input voltage directly without using a coupling transformer. FIG. 8 shows an example of such approach. As shown in FIG. 8 inductor 145, LED 210, power switch 130, and sense resistor 140 are connected in series and powered from the rectified voltage VDC directly. A freewheel diode 135 is connected across LED 210 and inductor 145 with its anode connected with the cathode of LED 210 and the cathode to VDC. During operation when power switch 130 is turned on, current flows from VDC through inductor 145, LED 210, power switch 130, resistor 140 and ramp up linearly. When 130 is turned off, the inductor current of 145 free wheels in the path of inductor 145, LED 210 and the free wheel diode 135 to keep its continuity.

Similar to the transformer coupled drive circuit as described in previous paragraphs, the operating behavior of such system can also be realized with different switching pattern of the power switching 130. A constant duty and fixed frequency operation makes the profile of the LED current to follow the change of voltage VDC, and a closed loop current mode control holds the LED current according to the control reference. Details of such operations are explained in the previous paragraphs with the transformer couple systems and will not be repeated herein. Similarly such circuit can form a dimmable lighting system with a conventional AC dimmer by operating at constant duty and fixed switching frequency, or at constant current with the burst dimming duty changes proportionally with the output voltage from the AC dimmer as the circuit in FIG. 4 does. By controlling the current of inductor 145 to follow the rectified input AC voltage sinusoidal waveform, it can also work as a single stage system with combined function of PFC and LED drive control. Without the existence of the transformer leakage inductance, the operating efficiency would be higher than the transformer coupled system when the LED operating voltage is not too far below the magnitude of the input voltage.

It should be noted that while certain embodiments of the inventions have been described, these embodiments have been presented by way of example only, and are not intended to limit the scope of the inventions. Indeed, the novel methods and systems described herein may be embodied in a variety of other forms. Furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

I claim:

1. A LED drive system comprising:

A bridge rectifier to rectify an AC input voltage,

A capacitor connected between the two DC output terminals of said bridge rectifier, A LED device, wherein the device is preferably a string of multiple LEDs or OLEDs in series, An inductor connected in series with the LED device, wherein one terminal of the inductor-LED serial network is connected to the positive output of the bridge rectifier, and the other terminal connected to the positive terminal of a power switching device, and wherein the direction of the LED device is such that it is forward biased when the power switching device is turned on, Said power switching device with its positive power terminal connected to the inductor-LED serial network, and with its negative power terminal connected to one terminal of a sense resistor, Said sense resistor with the other terminal connected to the negative output terminal of the bridge rectifier; and A freewheel diode with its anode connected to the positive power terminal of the power switching device, and with its cathode connected to the positive output of the bridge rectifier.

2. A LED drive system comprising:

A bridge rectifier to rectify an AC input voltage,

A first capacitor connected between the two DC output terminals of said bridge rectifier, A transformer with the dotted terminal of its primary winding connected to the positive DC output of the bridge rectifier, wherein the definition of dotted and non-dotted terminal has no any other meaning, except for the purpose of identifying the relative polarity relation between the primary and secondary windings of said transformer, A power switching device with its positive power terminal connected to the non-dotted terminal of the primary winding of said transformer, and with its negative power terminal connected to one terminal of a sense resistor, said sense resistor with the other terminal connected to the negative output terminal of the bridge rectifier, A diode device with its anode connected to the non-dotted terminal of the secondary winding of said transformer, and with its cathode connected to the anode of a LED or OLED device, wherein the LED or OLED device can be a single LED or OLED, or a string of multiple LEDs or OLEDs in series, A LED control switch with its positive power terminal connected to the cathode of said LED or OLED device, and with its negative power terminal connected to one terminal of a current sense resistor, wherein the other terminal of the current sense resistor is connected to the dotted terminal of the secondary winding of said transformer; and A second capacitor connected in parallel with said LED or OLED device.

3. A LED drive system comprising:

A bridge rectifier to rectify an AC input voltage,

A capacitor connected between the two DC output terminals of said bridge rectifier, A transformer with the dotted terminal of its primary winding connected to the positive DC output of the bridge rectifier, wherein the definition of dotted and non-dotted terminal has no any other meaning, except for the purpose of identifying the relative polarity relation between the primary and secondary windings of said transformer, A power switching device with its positive power terminal connected to the non-dotted terminal of the primary winding of said transformer, and with its negative power terminal connected to one terminal of a sense resistor, said sense resistor with the other terminal connected to the negative output terminal of the bridge rectifier, A circuitry connected to the secondary side of said transformer with a filter capacitor element to establish a DC voltage as a voltage source on its filter capacitor, wherein the DC voltage established on the filter capacitor is controlled by the switching operation of said power switching device on the primary side of said transformer; and LED or OLED devices consisting of multiple branches and being driven from said voltage source by a LED drive circuitry, wherein Said LED drive circuitry has individual output channels to drive each LED branch from the DC voltage source established on said filter capacitor.

4. The LED drive system according to claim 3, wherein it fulfills a power factor correction function and DC to DC voltage conversion in a single stage to establish a DC voltage on the secondary side to supply the LED drive circuitry.

* * * * *